US012806494B2

(12) United States Patent
Zaleznick et al.

(10) Patent No.: US 12,806,494 B2
(45) Date of Patent: Nov. 24, 2026

(54) VIBRATION DAMPERS OF SPORTS SHAFTS

(71) Applicant: TRUE TEMPER SPORTS, INC., Memphis, TN (US)

(72) Inventors: Jonah Zaleznick, San Diego, CA (US); Donovan Johnson, Ramona, CA (US); Donald Collins Brown, Jr., San Diego, CA (US); Brian Christopher Mollner, San Diego, CA (US)

(73) Assignee: TRUE TEMPER SPORTS, INC., Memphis, TN (US)

( * ) Notice: Subject to any disclaimer, the term of this patent is extended or adjusted under 35 U.S.C. 154(b) by 411 days.

(21) Appl. No.: 18/289,012

(22) PCT Filed: May 2, 2022

(86) PCT No.: PCT/US2022/027223
§ 371 (c)(1),
(2) Date: Oct. 31, 2023

(87) PCT Pub. No.: WO2022/240601
PCT Pub. Date: Nov. 17, 2022

(65) Prior Publication Data

US 2024/0216769 A1 Jul. 4, 2024

Related U.S. Application Data

(60) Provisional application No. 63/187,578, filed on May 12, 2021.

(51) Int. Cl.
*A63B 60/54* (2015.01)

(52) U.S. Cl.
CPC ..... *A63B 60/54* (2015.10)

(58) Field of Classification Search
CPC ..... A63B 60/54
See application file for complete search history.

(56) References Cited

U.S. PATENT DOCUMENTS

| | | | |
|---|---|---|---|
| 5,655,975 | A | 8/1997 | Nashif |
| 5,692,971 | A | 12/1997 | Williams |
| 5,788,586 | A | 8/1998 | Macioce |
| 6,117,028 | A | 9/2000 | You |

(Continued)

FOREIGN PATENT DOCUMENTS

| | | | |
|---|---|---|---|
| JP | 2003070944 | A | 3/2003 |
| JP | 2008029534 | A | 2/2008 |

OTHER PUBLICATIONS

Durometer Shore Hardness Scale Explained, Jul. 30, 2020, available on internet via URL https://www.aeromarineproducts.com/durometer-shore-hardness-scale/ (Year: 2020).*

(Continued)

*Primary Examiner* — Audrey B. Walter

(57) ABSTRACT

A vibration damper to be inserted within an interior cavity of a sports shaft includes: an outer portion configured to directly contact and engage the interior cavity of the sports shaft; a central mass that extends coaxially with the outer portion and that is disposed within the outer portion; at least two arms that extend outwardly and connect the central mass to the outer portion; and at least apertures disposed between the central mass and the outer portion.

16 Claims, 21 Drawing Sheets

(56) References Cited

U.S. PATENT DOCUMENTS

| | | | | |
|---|---|---|---|---|
| 6,709,352 | B1 * | 3/2004 | Albin | A63B 59/50 473/566 |
| 6,764,414 | B2 | 7/2004 | Kumamoto | |
| 7,500,922 | B2 | 3/2009 | Takeuchi | |
| 2003/0040370 | A1 | 2/2003 | Gartner et al. | |
| 2003/0092502 | A1 | 5/2003 | Pergande et al. | |
| 2003/0148820 | A1 | 8/2003 | Kumamoto | |
| 2005/0116403 | A1 | 6/2005 | Wellman | |
| 2014/0151528 | A1 | 6/2014 | Park | |
| 2018/0361215 | A1 * | 12/2018 | Van Nguyen | A63B 59/54 |
| 2021/0121754 | A1 * | 4/2021 | Chauvin | A63B 59/56 |

OTHER PUBLICATIONS

International Search Report and Written Opinion of the ISA issued in PCT/US2022/027223, mailed Aug. 23, 2022; ISA/KR.
Supplementary European Search Report for European U.S. Appl. No. 22/808,044 dated Mar. 5, 2025.
Japanese Office Action for Japanese Application No. 2023-569896 dated Feb. 6, 2026.

* cited by examiner

VIBRATION DAMPERS OF SPORTS SHAFTS

CROSS-REFERENCE TO RELATED APPLICATIONS

This application is a U.S. National Phase Application under 35 U.S.C. 371 of International Application No. PCT/US2022/027223, filed on May 2, 2022, which claims the benefit of U.S. Provisional Application No. 63/187,578, filed on May 12, 2021. The entire disclosures of the applications referenced above are incorporated herein by reference.

FIELD

The present disclosure relates to sports shafts, such as golf shafts, lacrosse shafts, hockey shafts, and baseball bats, and more particularly to vibration suppression devices for sports shafts.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Golf shafts are manufactured in various lengths for various different types of golf clubs. Some golf shafts are steel golf shafts, and some golf shafts are graphite golf shafts.

In golf, golf clubs are used to strike golf balls. An object is to move a golf ball from tee to a hole in a fewest number of strokes. Various types of golf clubs are used, such as woods, irons, wedges, and putters. Golf shafts include a tip end where a golf club head is attached and a butt end where a golf grip is applied.

Striking a golf ball with a golf club generates vibration within the golf shaft that may be felt by the hands, even though the golf grip. Different vibration may be felt when a golf ball is struck in a sweet spot of the golf club relative to when the golf ball is struck in another portion of the golf club, such as the heel or toe of the golf club.

Sports shafts are used to strike or move sports equipment in other sports. For example, a hockey stick is used to strike a hockey puck or ball in hockey. In baseball, baseball bats are used to strike baseballs. In lacrosse, lacrosse sticks are used to move and pass lacrosse balls. Other sports use other types of sports shafts.

Vibration experienced by hands of a user via a sports shaft may be unpleasant.

SUMMARY

In a feature, a vibration damper to be inserted within an interior cavity of a sports shaft includes: an outer portion configured to directly contact and engage the interior cavity of the sports shaft; a central mass that extends coaxially with the outer portion and that is disposed within the outer portion; at least two arms that extend outwardly and connect the central mass to the outer portion; and at least apertures disposed between the central mass and the outer portion.

In further features, a fraction of (a) a mass of the central mass and the at least two arms divided by (b) a total mass of the vibration damper is greater than one half.

In further features, the vibration damper has a uniform mass per unit length.

In further features, the outer portion, the central mass, and the at least two arms are made of a material having a hardness between approximately 40 and 100 A-shore hardness as measured by a shore durometer.

In further features, the outer portion, the central mass, and the at least two arms are made of one of a viscoelastic material, an elastomeric material, thermoplastic polyurethane (TPU), polytetrafluoroethylene (PTFE), a rubber, a urethane poured foam, a solid foam, and a twisted braided round foam.

In further features, the outer portion forms a cylindrical tube having an outer diameter that is between approximately a 7/16 inches (1.11125 centimeters) and ½ inches (1.27 centimeters).

In further features, the vibration damper is one of extruded, molded, and three dimensionally printed.

In further features, the at least two arms include three arms that extend outwardly and connect the central mass to the outer portion.

In further features, the three arms include: a first arm that extends radially outwardly from the central mass to the outer portion; a second arm that includes a first portion that extends radially outwardly from the central mass toward the outer portion and a second portion that extends from to the first portion and to the outer portion; and a third arm that includes a third portion that extends radially outwardly from the central mass toward the outer portion and a fourth portion that extends from to the third portion and to the outer portion.

In further features, a length of the vibration damper is between approximately 0.5 and 8 inches.

In further features, a total mass of the vibration damper is between 2 and 4 grams.

In further features, at least one of the at least two arms includes a curved portion.

In further features, the at least two arms include four arms.

In further features, the four arms each include a first concave portion and a second concave portion.

In further features, the first concave portion extends radially outwardly from the central mass in one of a clockwise direction and a counterclockwise direction and the second concave portion extends outwardly in the other one of the clockwise direction and the counterclockwise direction.

In further features, an outer surface of the outer portion includes features configured to engage the interior cavity of the sports shaft.

In further features, the outer portion forms one of a squircle shaped tube, a cylindrical tube, a hexagonal tube, a rectangular tube, and an octagonal tube.

In further features, one or more sides of the outer portion are one of convex and concave.

In further features, the central mass incudes a hollow aperture through its center.

In further features, an insert is disposed within the hollow aperture.

In further features, the at least two arms each include at least one protrusion.

In a feature, a sports shaft includes: an elongated tubular portion having an inner cavity; and a vibration damper including: an outer portion configured to directly contact and engage the inner cavity of the sports shaft; a central mass that extends coaxially with the outer portion and that is disposed within the outer portion; at least two arms that extend outwardly and connect the central mass to the outer portion; and at least apertures disposed between the central mass and the outer portion.

In further features, the sports shaft is one of a golf shaft, a hockey stick shaft, a lacrosse stick shaft, and a baseball bat.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

The present application involves hollow sports shafts (e.g., golf shafts, hockey stick shafts, baseball bats, lacrosse sticks, etc.) including one or more vibration damping devices (also referred to as vibration dampers and vibration suppression devices) located within the sports shafts. The vibration damping device(s) damp vibration that may otherwise be felt by one or more hands.

Each vibration damping device includes an outer portion that engages an inner portion of a sports shaft. The vibration suppression device also includes (a) a central mass and (b) two or more arms that connect the central mass to the outer portion. At least a predetermined fraction (e.g., one-half) of the total mass of the vibration suppression device lies in the central mass and the arms to maximize vibration damping. The vibration suppression device decreases vibration that could otherwise be felt by one or more hands of a user in response to contact with a sports object, such as a ball, puck, etc.

Figure 1:
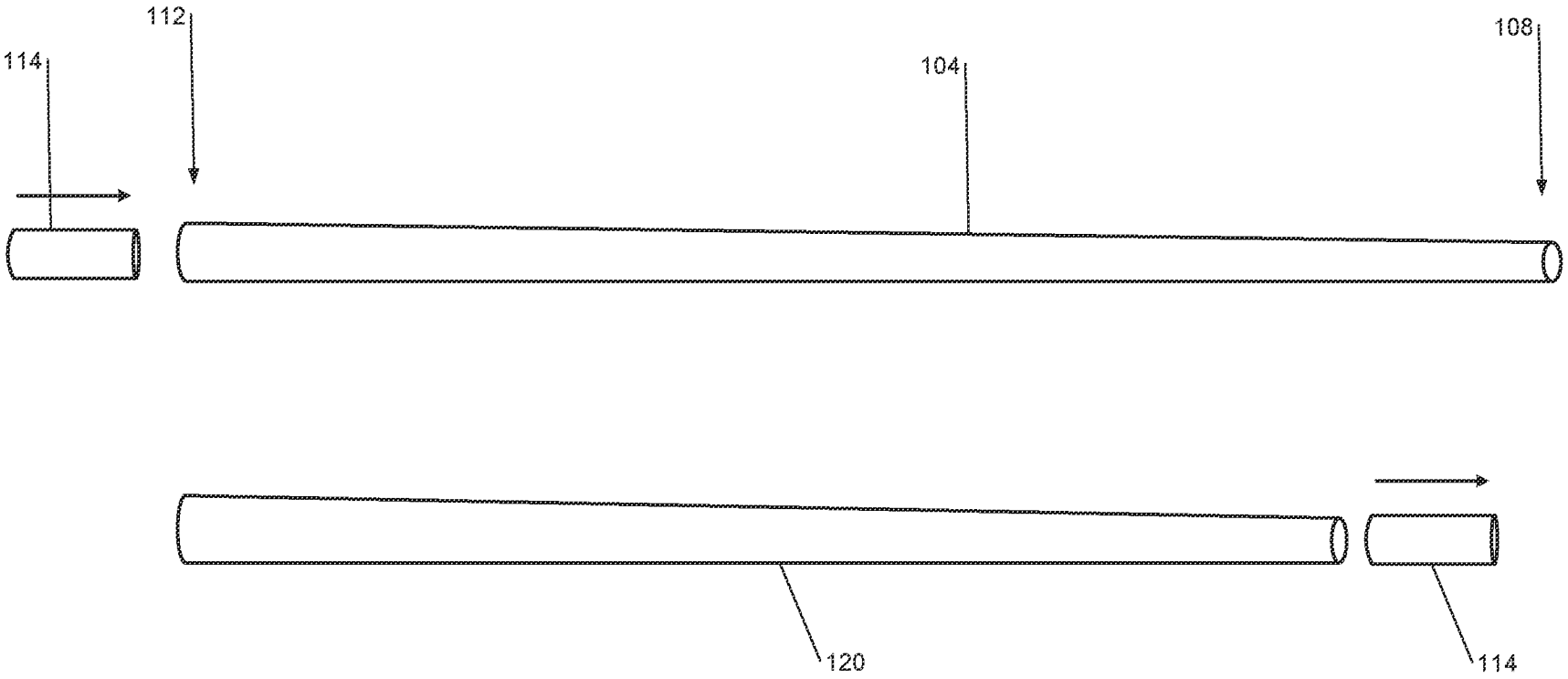
FIG. 1 includes an example illustration of a golf club shaft and a vibration damper prior to insertion of the vibration damper into an interior of the golf shaft.

FIG. 1 includes an example illustration of a golf club shaft 104 and a vibration damper 114 prior to insertion of the vibration damper 114 into an interior of the golf shaft 104. The golf shaft 104 may be a graphite golf club shaft, a steel golf club shaft, a hybrid steel and graphite golf club shaft, or another type of golf club shaft. The golf shaft 104 may include one or more tapered (stepped) outer portions or may be a stepless shaft. An interior of the golf shaft 104 is hollow.

The golf shaft 104 includes a tip end 108 and a butt end 112. The outer diameter of the butt end 112 is greater than the outer diameter of the tip end 108. A golf club head can be attached to the tip end 108 of the golf shaft 104. A golf grip can be fixed at the butt end 112 of the golf shaft 104 and extend toward the tip end 108. An interior diameter of the golf shaft 104 may decrease moving from the butt end 112 toward the tip end 108.

The vibration damper 114 may have a uniform mass per unit length. The vibration damper 114 is made of a material having a hardness between approximately 40 and 100 A-shore hardness or a hardness between approximately 50 and 90 A-shore hardness as measured by a shore durometer. Having a hardness within these ranges may provide more desirable vibration damping characteristics than other hardnesses. The material may be, for example, a viscoelastic material, an elastomeric material, thermoplastic polyurethane (TPU), polytetrafluoroethylene (PTFE), a rubber, a urethane poured foam, a solid (e.g. open or closed cell) foam, a twisted braided round foam (e.g., 0.25 inch) or another suitable material within the hardness ranges provided above.

An inserting rod 120 may be used to insert the vibration damper 114 into the golf shaft 104. The inserting rod 120 may be moved linearly approximately coaxially with the golf shaft 104 into the hollow interior of the golf shaft 104 to push the vibration damper 114 to a predetermined location within the interior of the golf shaft 104. The predetermined location is between the tip end 108 and a location where a golf grip will end. More generally speaking, the predetermined location is between the tip end 108 and where hands are intended to be placed on the golf shaft 104.

For example only, the inserting rod 120 may apply at least approximately 200 pounds of force (approximately 889 Newtons) to the vibration damper 114 while the golf shaft 104 is held stationary to insert the vibration damper 114 into the golf shaft 104. The force applied to the vibration damper 114, however, may be greater than or less than 200 pounds. A linear actuator may linearly actuate the inserting rod 120 into the golf shaft 104 to insert the vibration damper 114. In various implementations, the inserting rod 120 may be inserted manually by a human.

The insertion of the vibration damper 114 may create an interference fit between the vibration damper 114 and the interior of the golf shaft 104. A vibration damper is added to each golf shaft to damp vibration of that golf shaft.

In the example of a golf shaft, the vibration damper 114 may have, for example, a 7/16" (1.11125 centimeter) outer diameter, a ½" (1.27 centimeter) outer diameter, an outer diameter between approximately 7/16" and approximately ½", or another suitable outer diameter. The outer diameter of the vibration damper 114 may be greater than an inner diameter at a predetermined location, such as a location ⅔ of the way from the butt end 112 to the tip end 108. The outer diameter of the vibration damper 114 being greater than the inner diameter of the golf shaft 104 may cause the vibration damper 114 to deform slightly during insertion into golf shaft yet not plug the golf shaft. Plugging of a golf shaft (as may occur if solid/non-hollow vibration dampers were used) may make securing a golf club head and/or a grip to the golf shaft difficult and non-optimal. Plugging may also trap water within a golf shaft.

As discussed above, the vibration damper 114 may be held within the golf shaft 104 via an interference fit. Additionally or alternatively, the golf shaft 104 may be subjected to one or more heat treatments for one or more predetermined periods, respectively. For example, the golf shaft 104 may be heated (e.g., by a furnace) to a predetermined temperature that is less than or equal to the melting point temperature of the vibration damper 114 for a predetermined period. In various implementations, the predetermined temperature may be greater than the melting point temperature of the insert. In such an implementation, the predetermined period may be set low enough to allow for melting of an exterior portion skin of the vibration damper 114 while preventing melting of the remainder of the vibration damper 114.

The heating of the golf shaft 104 and the vibration damper 114 may adhere the vibration damper 114 to the interior surface of the golf shaft 104 and increases a force necessary to remove the vibration damper 114 from the golf shaft 104. In various implementations, the vibration damper 114 may be fixed within the golf shaft 104 via an adhesive between the outer surface of the vibration damper 114 and the inner surface of the golf shaft 104. In various implementations, double-sided tape may be disposed between the outer surface of the vibration damper 114 and the inner surface of the golf shaft 104 to fix the vibration damper 114 within the golf shaft 104. The vibration damper 114 may be fixed in another suitable manner.

Figure 2:
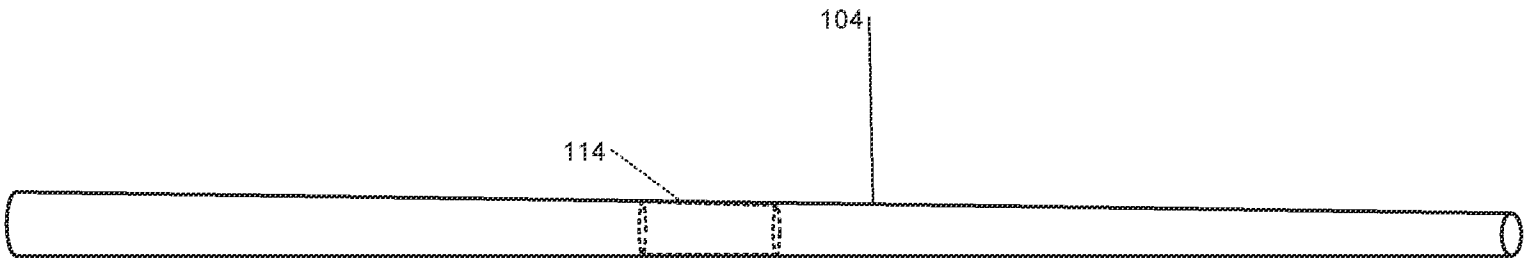
FIG. 2 is an example illustration of the vibration damper fixed within the interior of the golf shaft.

FIG. 2 is an example illustration of the vibration damper 114 fixed within the interior of the golf shaft 104. While the example of golf shafts is described first, the present application is also applicable to vibration dampers in other sports shafts, such as hockey sticks (e.g., FIGS. 8 and 9), lacrosse sticks (e.g., FIG. 14), baseball bats (e.g., FIG. 17) and other types of hollow sports shafts. The vibration dampers 114 discussed herein may be, for example, extruded, molded, printed (e.g., via three dimensional printing), or manufactured in another suitable manner.

Figure 3:
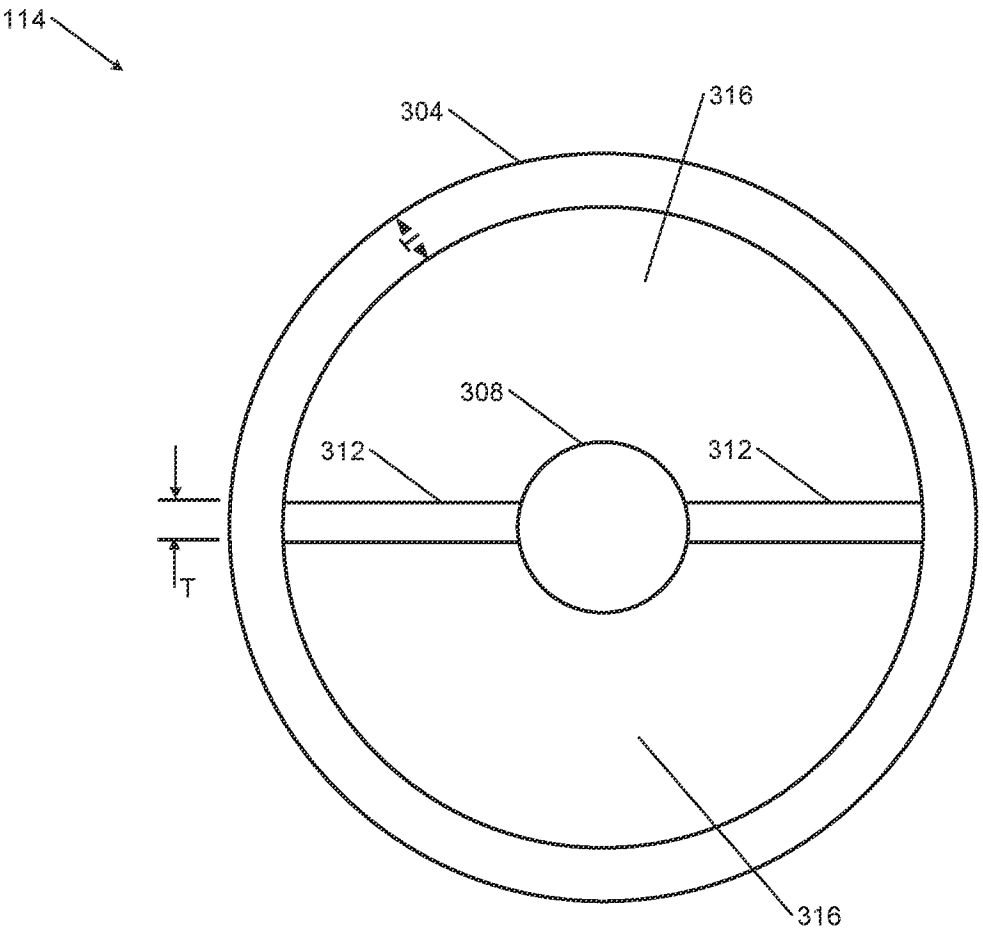
FIG. 3 includes an end cross-sectional view of an example implementation of the vibration damper for golf shafts.

FIG. 3 includes an end cross-sectional view of an example implementation of the vibration damper 114 for golf shafts. Generally speaking, the vibration dampers 114 of different sport shafts include an outer portion having an outer geometry or shape that is the same or similar as an inner geometry or shape of the associated sports shaft. The outer portion of each vibration dampers is configured to engage the inner surface of the associated sports shaft. Vibration dampers also include two or more arms that connect a central portion of the vibration damper to the outer portion of the vibration damper.

For example, golf shafts have a hollow circular inner shape. As the inner portion of a golf shaft may be tapered, the inner portion of the golf shaft may be frustoconical. In various implementations, the inner portion of golf shafts may be non-tapered and cylindrical. As shown in FIG. 3, the vibration damper 114 of the golf shaft 104 includes a circular outer portion 304. The circular outer portion 304 may form a hollow cylindrical tube or a hollow frustoconical tube.

The vibration damper 114 also includes a central portion 308 that is connected to the circular outer portion 304. The central portion 308 may be a solid cylindrical member or have another suitable shape. The central portion 308 is connected to the circular outer portion 304 via two or more arms, such as arms 312. The arms 312 extend outwardly (e.g., radially outwardly) from the central portion 308 to the circular outer portion 304 in the example of FIG. 3. Apertures 316 are disposed between the arms and between the outer portion 304 and the central portion 308. Generally speaking, the central portion of a vibration damper extends coaxially with the outer portion of the vibration damper.

A thickness of the circular outer portion 304 may be minimized (e.g., less than a predetermined thickness) to maximize a mass of the vibration damper 114 attributable to the arms 312 and the central portion 308. Maximizing a mass of the arms 312 and the central portion 308 increases the damping provided by the vibration damper 114.

Figure 4:
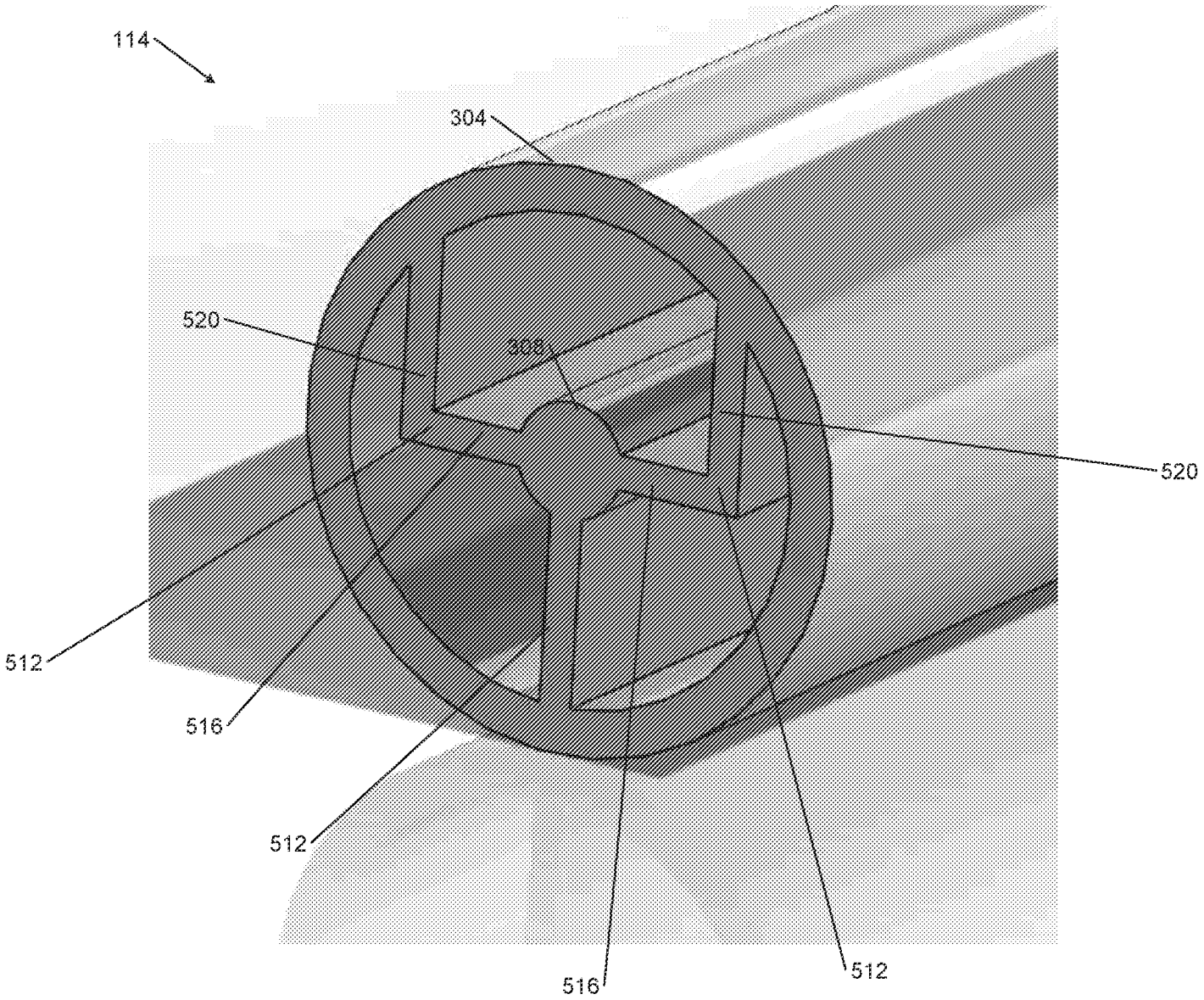
FIG. 4 is a zoomed perspective end view of a portion of an example implementation of the vibration damper for golf shafts.

FIG. 4 is a zoomed perspective end view of a portion of another example implementation of the vibration damper 114 for golf shafts. The example of FIG. 5 includes a cross sectional view 504, a side view 508, and a perspective view 510 of the vibration damper 114 of FIG. 4. As shown in FIG. 4, the vibration damper 114 may include three arms 512.

Figure 5:
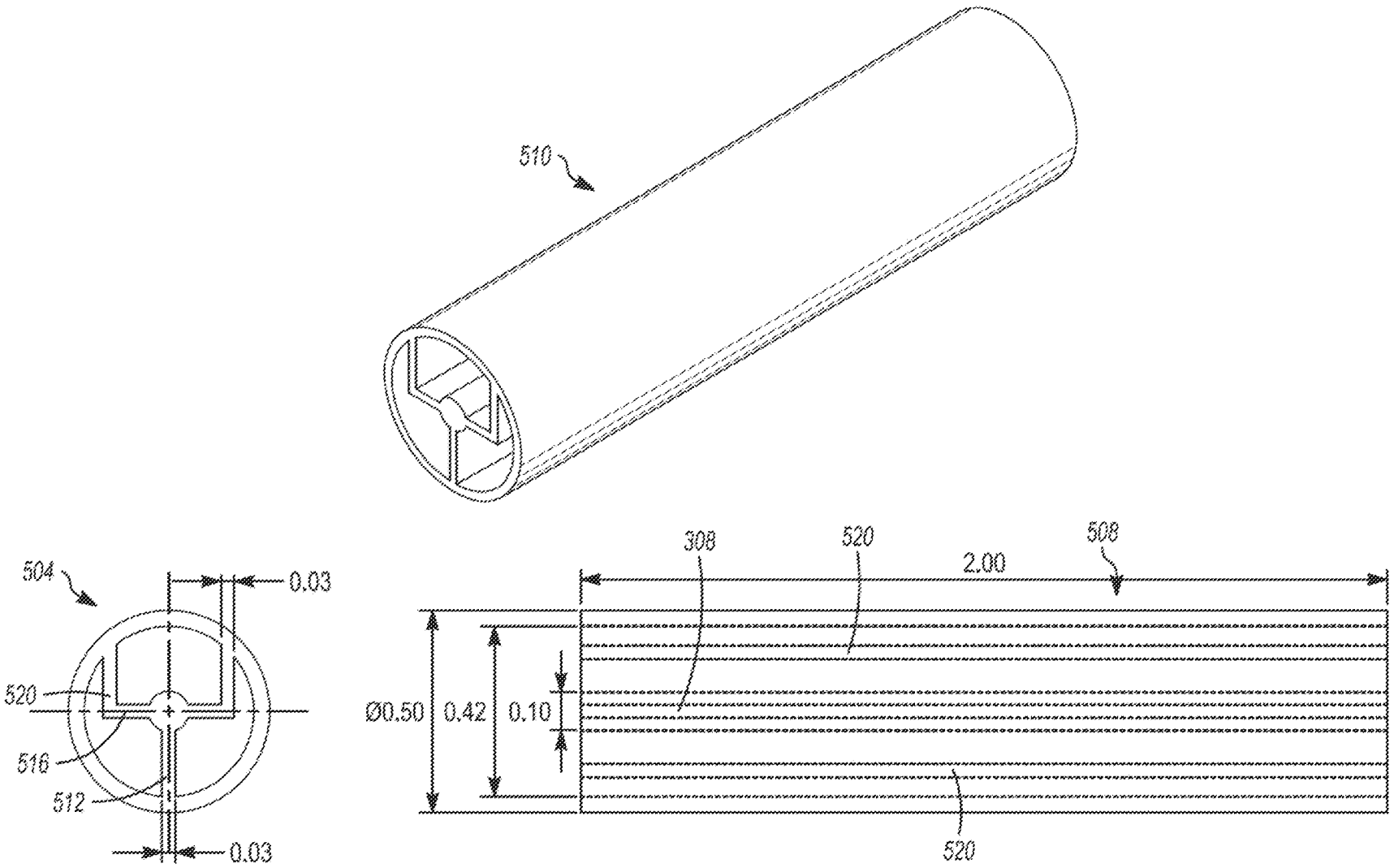
FIG. 5 includes a cross sectional view, a side view, and a perspective view of the vibration damper of FIG. 4.

In the example of FIGS. 4-5, one of the arms 512 extends radially outwardly from the central portion 308 to the circular outer portion 304. The other two of the arms 512 each include two portions: a first portion 516 that extends radially outwardly from the central portion 308 toward the circular outer portion 304; and a second portion 520 that extends perpendicularly to the first portion 516 and to the circular outer portion 304. The first portions 516 do not extend to the circular outer portion 304. Example dimensions (in inches) for the vibration damper 114 are provided in FIG. 5. As shown, the vibration damper 114 may have a length of 2 inches or another suitable length between 0.5 and 5 inches. The example of FIGS. 4 and 5 may be less costly to manufacture than other vibration dampers for golf shafts, such as the example vibration damper of FIG. 3 and the examples of FIGS. 6 and 7.

While example dimensions are provided, the present application is also applicable to other dimensions. For example, thicknesses of the arms and the circular outer portion of the vibration damper 114 may be between 0.02 and 0.04 inches in various implementations. A fraction of (a) a mass of the central portion 308 and the arms divided by (b) a total mass of the vibration damper 114 (the mass of the central portion 308, the arms, and the circular outer portion) may be greater than a predetermined fraction to maximize vibration damping. The predetermined fraction is greater than zero and may be, for example, greater than ½ (50%), approximately ⅗ (60%), approximately ¾ (75%), or another suitable fraction less than 1. Approximately may mean+/−10%. The total mass of the vibration damper 114 may be between 2 and 4 grams, such as to minimize the total mass of the golf shaft 104.

Figure 6:
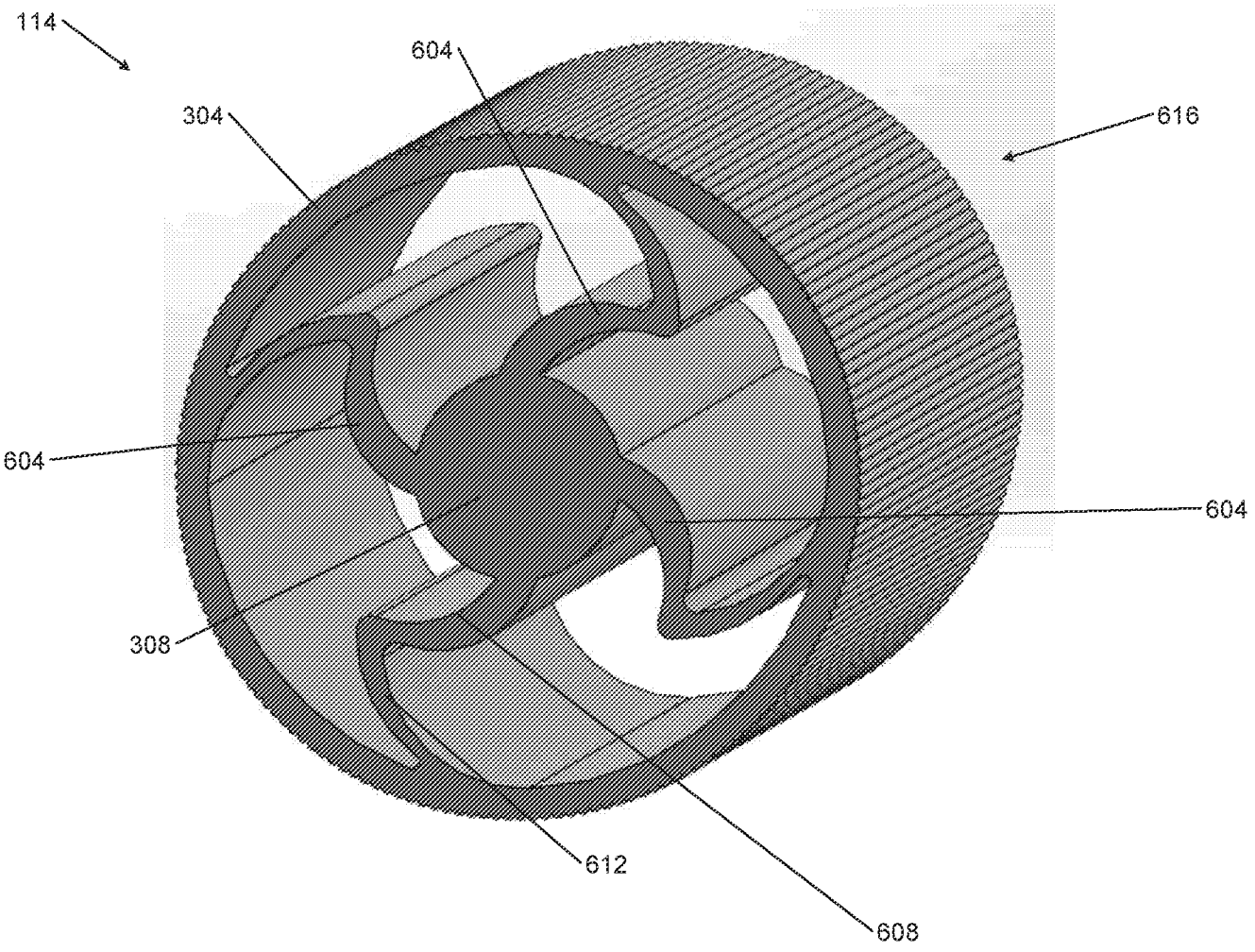
FIG. 6 is a perspective end view of another example implementation of the vibration damper for golf shafts.
Figure 22:
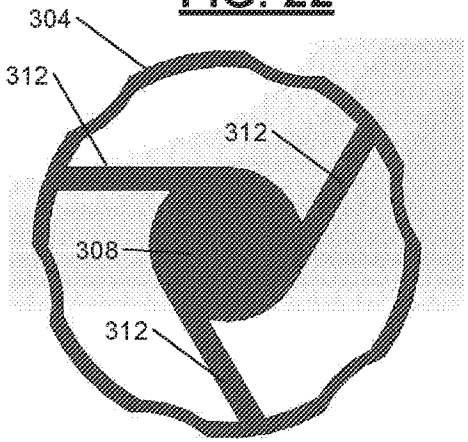
Figure 23:
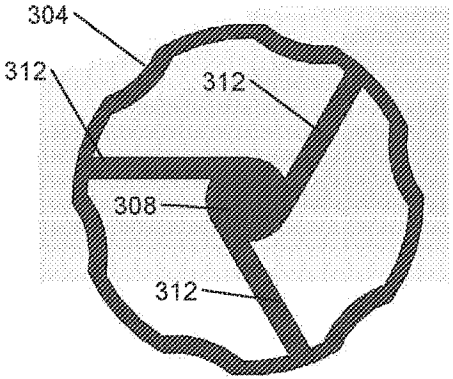
Figure 24:
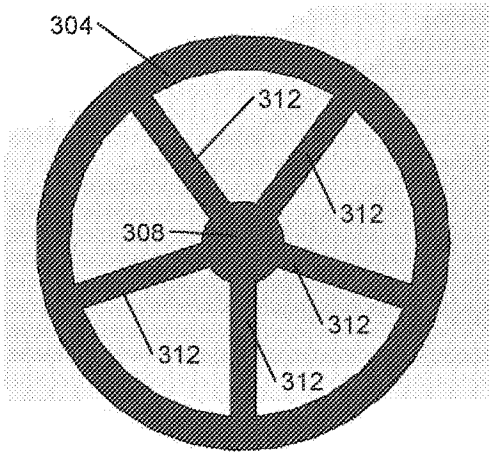

FIG. 6 is a perspective end view of another example implementation of the vibration damper 114 for golf shafts. As shown in FIG. 6, the vibration damper 114 may include four arms 604. Each of the arms 604 may include one or more curved portions. For example, each of the arms 604 may include a first concave portion 608 and a second concave portion 612. The first concave portion 608 may extend radially outwardly from the central portion 308 in a first direction (e.g., counterclockwise), and the second concave portion 612 may extend outwardly in a second direction (e.g., clockwise) that is different than (e.g., opposite) the first direction. The radially outer portion of the circular outer portion 304 may not be smooth and may include features such as ridges, scallops, concave portions, convex portions, and/or projections, such as generally illustrated by 616. The features 616 may provide a better interference/friction fit between the vibration damper 114 and the golf shaft 104. Other example features that can be disposed on the radially outer edge of the circular outer portion 304 are provided in FIGS. 22 and 23.

Figure 7:
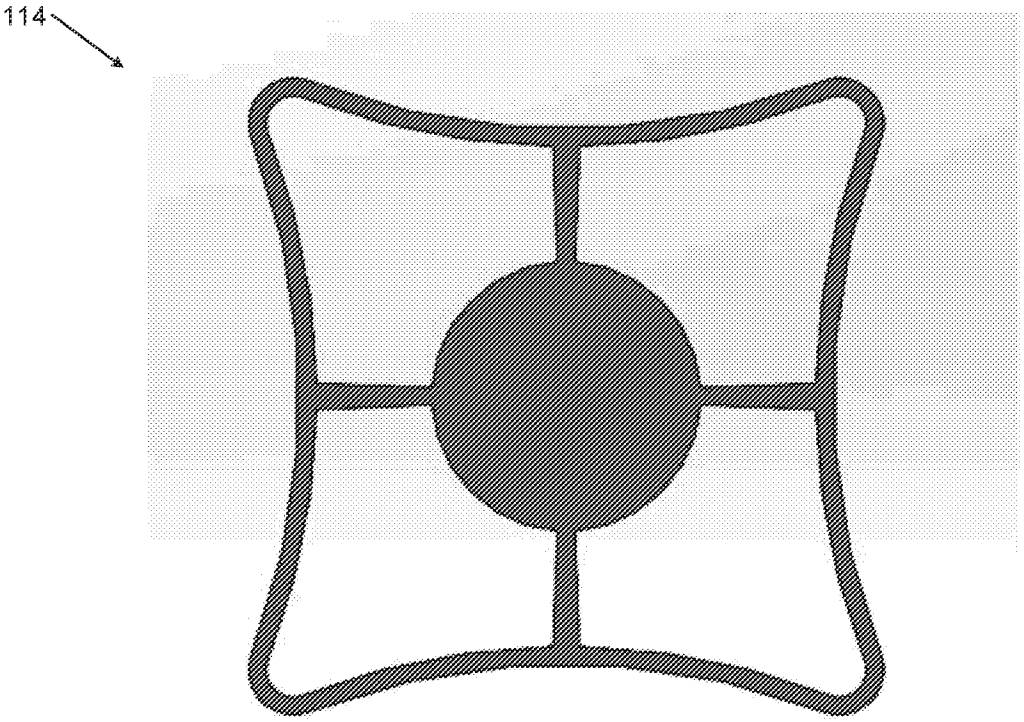
FIG. 7 is a cross-sectional end view of an example implementation of the vibration damper for golf shafts.

FIG. 7 is a cross-sectional end view of another example implementation of the vibration damper 114 for golf shafts. As illustrated, the outer portion of the vibration damper 114 may be non-circular. For example, the outer portion may be the shape of a squircle (a square with rounded corners). In various implementations, the sides of the squircle may be convex, such as illustrated in FIG. 7.

Figure 25:
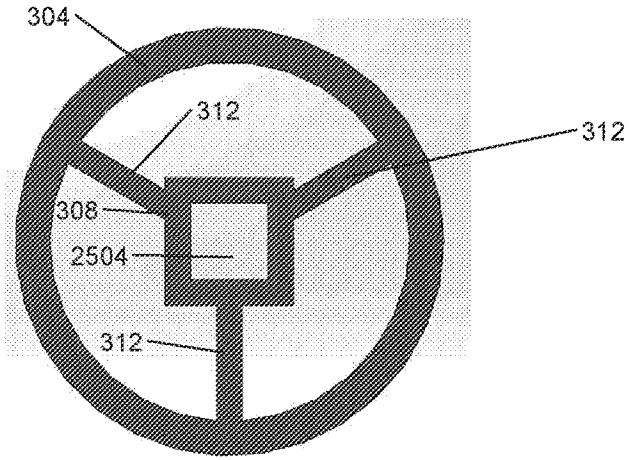
Figure 26:
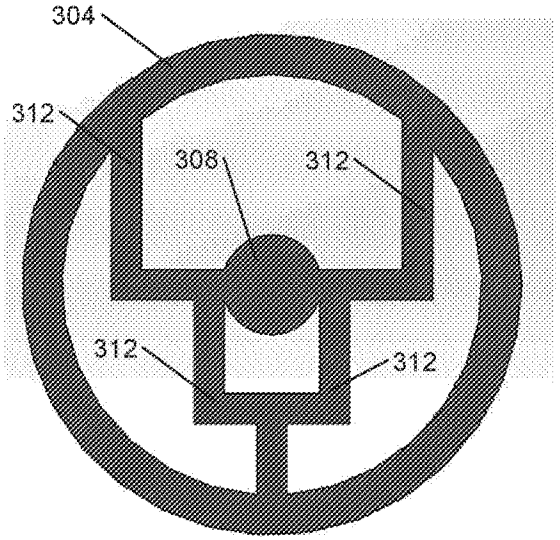
Figure 27:
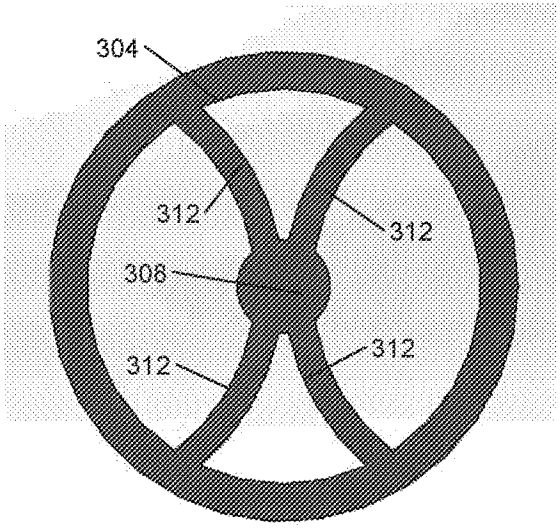
Figure 28:
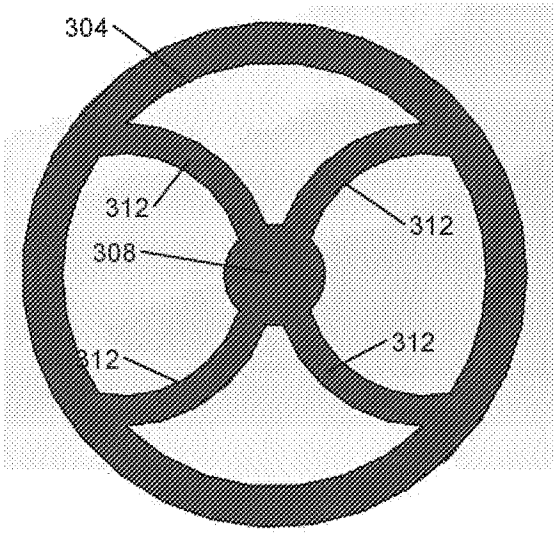

Other example implementations of the vibration damper 114 for golf shafts and baseball bats are provided in FIGS. 19-28. As shown in the example of FIG. 25, the central portion 308 may be hollow and include an aperture 2504. One or more materials (e.g. metal) may be inserted into the aperture 2504 to increase a mass of the central portion 308 and increase damping. While the example of a square central portion 308 and a square aperture 2504 is provided, the central portion 308 and the aperture 2504 may be another suitable shape such as circular, triangular, ovular, diamond, rectangular, etc. The hollow central portion and aperture may also be used with hockey sticks and lacrosse sticks.

Figure 8:
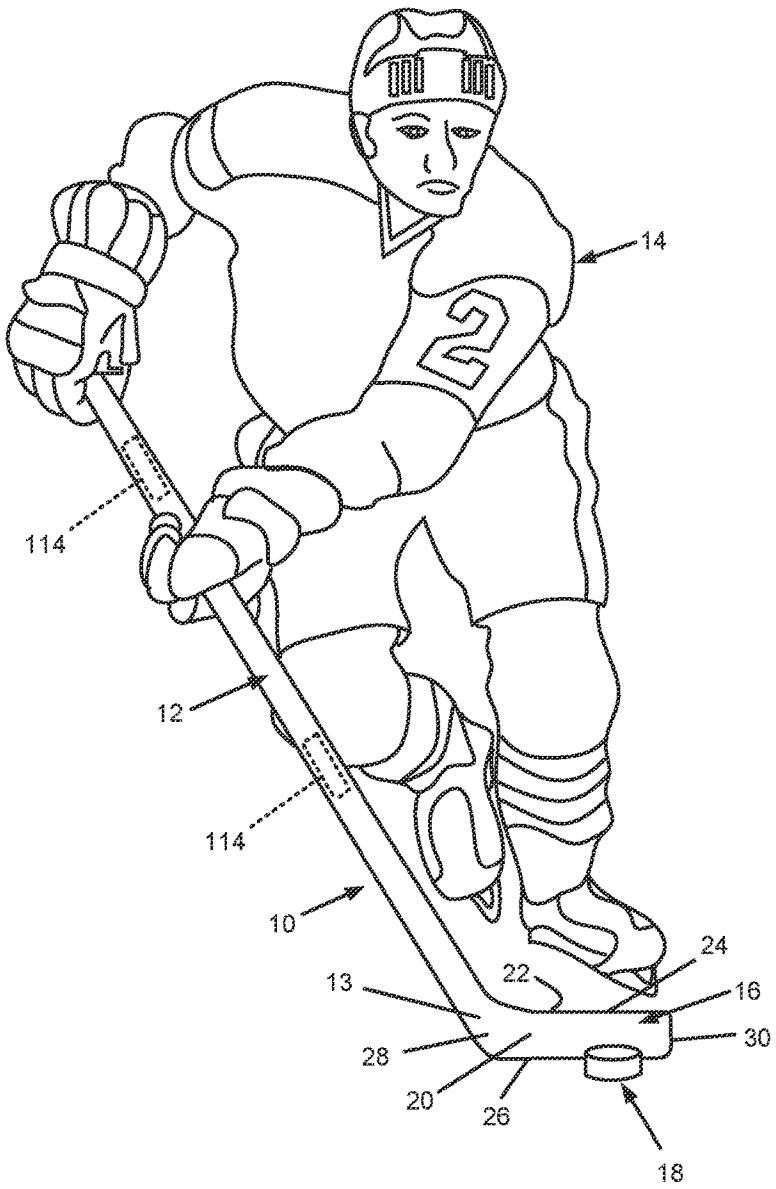
FIG. 8 includes an example illustration including a hockey stick including a vibration damper.
Figure 9:
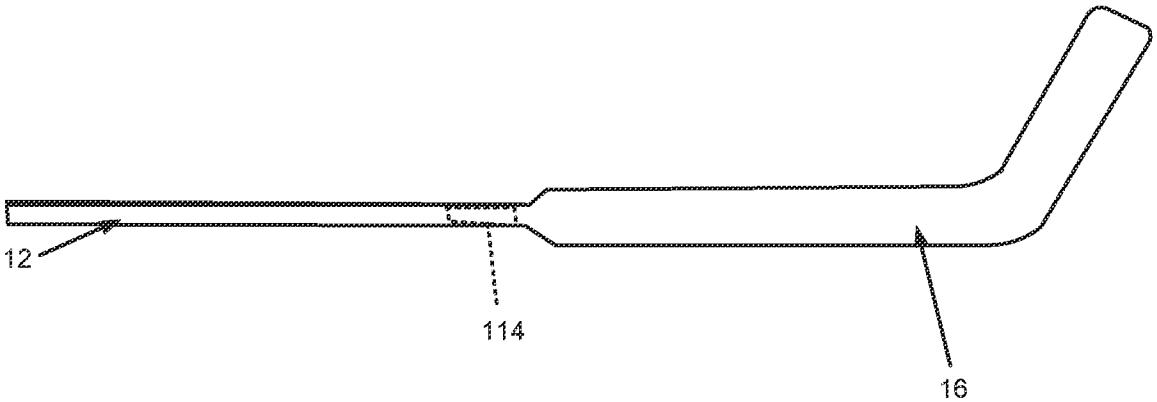
FIG. 9 includes an example illustration including a goalie hockey stick including a vibration damper.

FIG. 8 includes an example illustration including a (player) hockey stick 10 including a vibration damper 114. FIG. 9 includes an example illustration including a goalie hockey stick 10. The hockey stick 10 includes a stick (or handle) portion 12 (i.e., shaft), which a player 14 holds, and a blade portion 16 (i.e., blade), which is used for controlling a hockey puck 18 or a ball. The hockey stick 10 can be adapted for any position on a hockey team, including that of a goalie. In other words, the hockey stick 10 may be a goalkeeper hockey stick (e.g., as in FIG. 9) or a hockey stick configured to be used by other positions in hockey (a player stick, e.g., as in FIG. 8). While the example of an ice hockey stick will be provided, the present application is also applicable field hockey sticks, roller hockey sticks, and other types of sports equipment.

Figure 10:
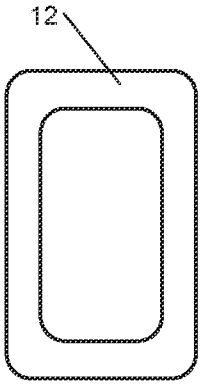
FIG. 10 includes a cross sectional view of an example implementation of the handle portion of a hockey stick.

The handle portion 12 can be elongated, hollow, and longitudinally straight. In some embodiments, the handle portion 12 can include a hollow core that is embedded and wrapped within a covering (e.g., composite material with carbon fibers). FIG. 10 includes a cross sectional view of an example implementation of the handle portion 12. The handle portion 12 may have a generally rectangular cross section. As shown in FIG. 10, one or more corners of may be rounded. One or more of the sides of the rectangular cross section may be convex in various implementations.

Referring back to FIG. 8, the handle portion 12 includes a blade connecting end 13. The blade portion 16 is fixed to the blade connecting end 13 of the handle portion 12. The blade portion 16 can be fixed to the blade connecting end 13 in any suitable manner. The handle portion 12 and the blade portion 16 can be manufactured separately and subsequently attached together. Alternatively, the handle portion 12 and the blade portion 16 may be manufactured together.

The blade portion 16 generally includes a front face 20, which can be used for receiving and moving the hockey puck 18 (e.g., passing, shooting, stopping, etc.), and a rear face 22, which can also be used for receiving and moving the hockey puck 18. The blade portion 16 also includes a first end 28 that is connected to the blade connecting end 13 of the handle portion 12. The blade portion 16 also includes a second end 30 that is opposite to the first end 28.

The blade portion 16 also includes an upper edge 24 and a lower edge 26 that is opposite the upper edge 24. The upper edge 24 is typically spaced away from a playing surface (e.g., ice). The lower edge 26 may contact the playing surface.

Both the upper and lower edges 24 and 26 extend between the first and second ends 28 and 30 of the blade portion 16. The upper and lower edges 24 and 26 and the front and rear faces 20 and 22 can have a curvature between the first and second ends 28 and 30 such that the front face 20 is concave while the rear face 22 is convex or vice versa. In various implementations, such as in the example of a goalie stick, the blade portion 16 may be flat.

As shown in FIGS. 8-9, a vibration damper 114 may be disposed within the interior of the handle portion 12 to damp vibration, such as vibration attributable to contact with the hockey puck 18 or ball. The vibration damper 114 (e.g., a longitudinal center) may be disposed a predetermined distance away from the place where the blade portion 16 and the handle portion 12 connect. The predetermined distance may be, for example, 1-3" or another suitable distance in the example of a goalie stick. The predetermined distance may be 4-8" in the example of the player stick. As shown in FIG. 8, two vibration dampers 114 may be included within the handle portion 12 of a player stick. For example, a second vibration damper 114 may be disposed in the handle portion 12 between where hands of a player generally hold the hockey stick.

Figure 11:
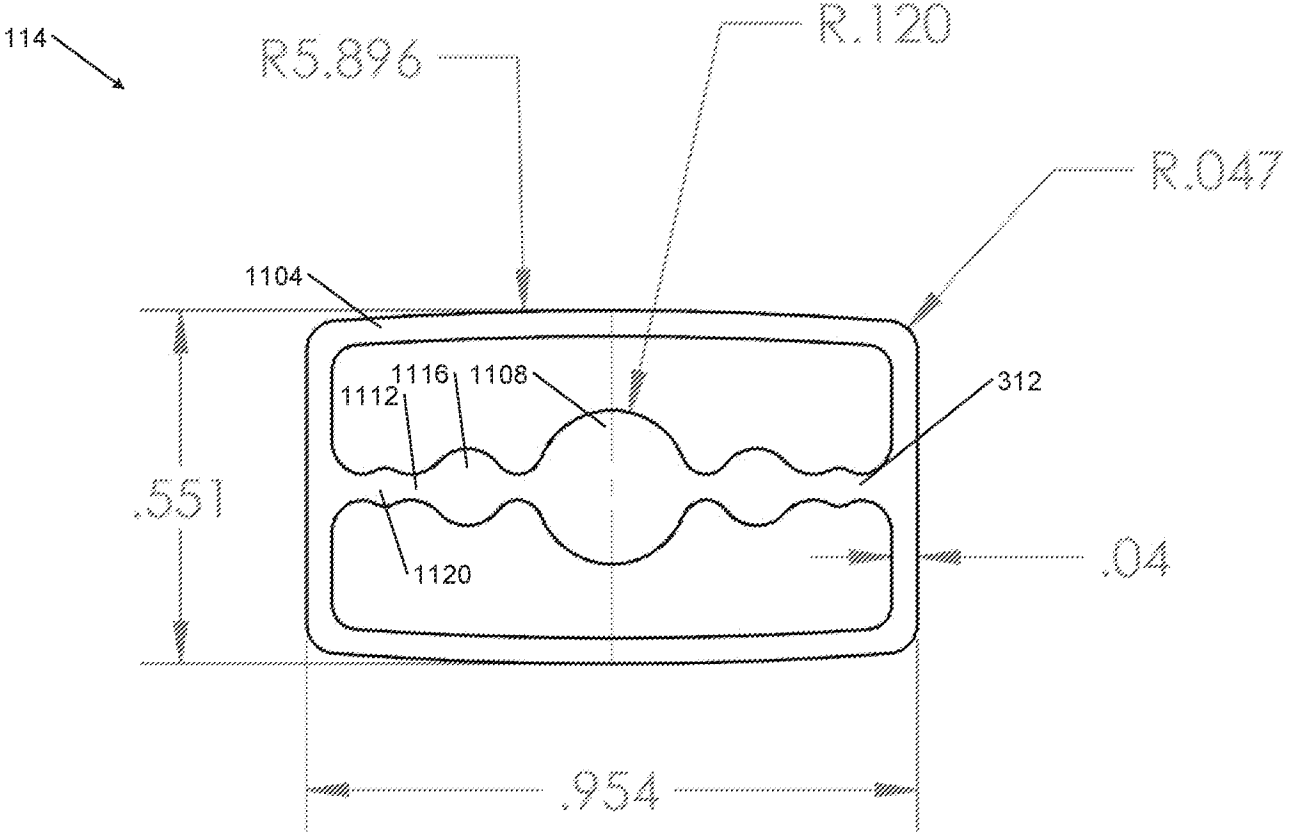
FIG. 11 includes a cross-sectional view of an example implementation of the vibration damper for a hockey stick.
Figure 12:
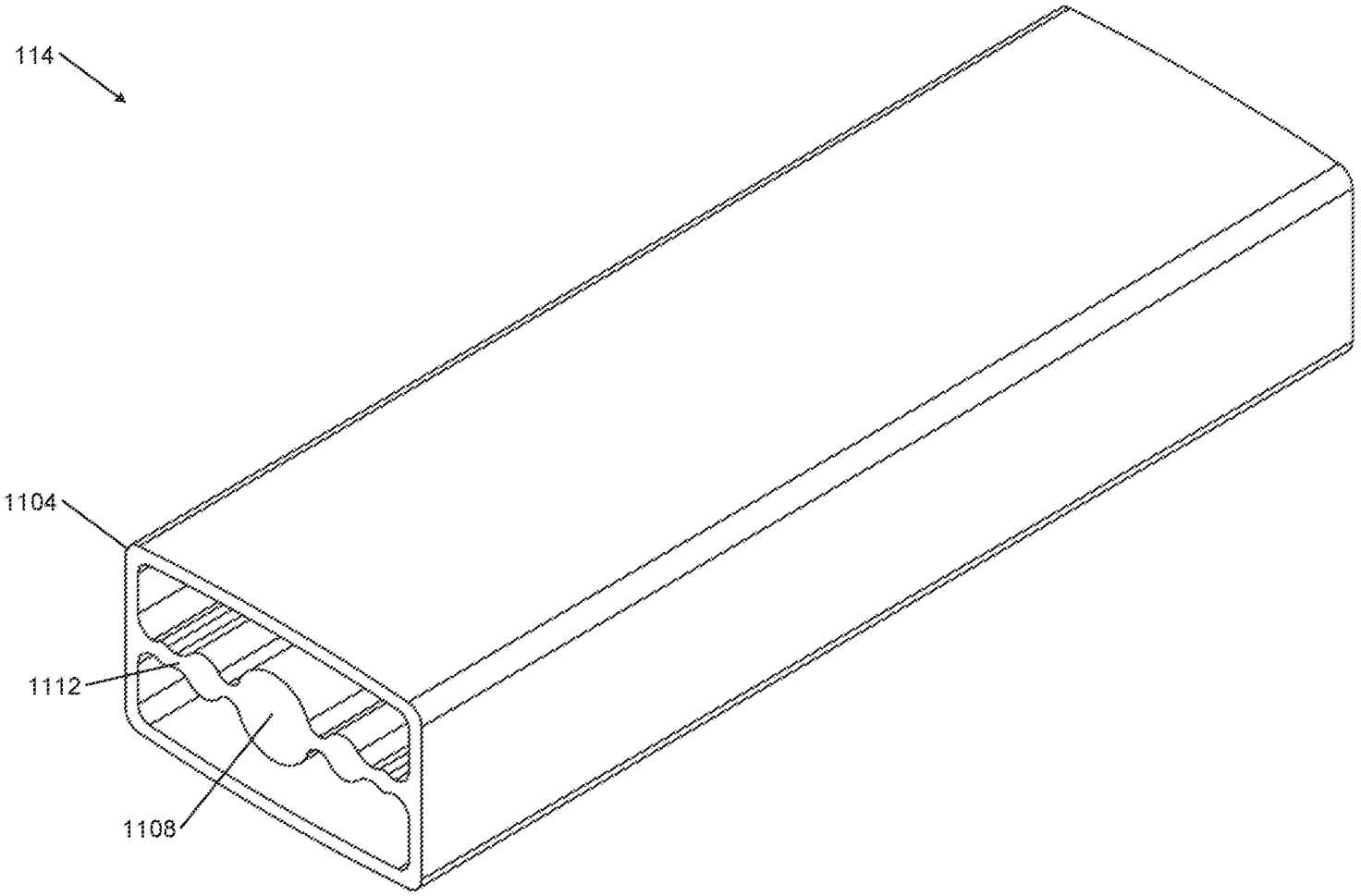
FIG. 12 includes a perspective view of the vibration damper of FIG. 11.
Figure 13:
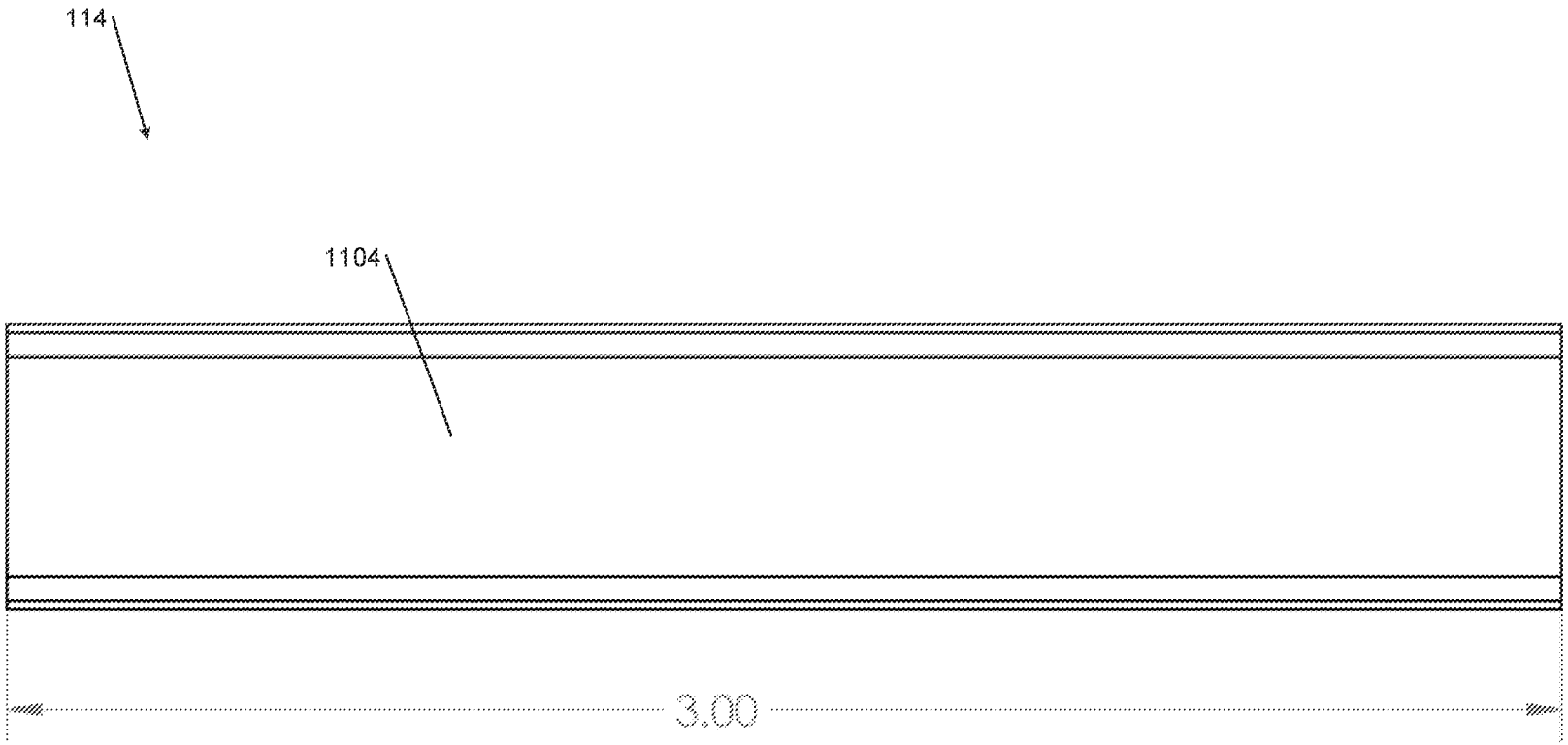
FIG. 13 includes a side view of the vibration damper of FIG. 11.

FIG. 11 includes a cross-sectional view of an example implementation of the vibration damper 114 for a hockey stick (a player stick or a goalie stick). FIG. 12 includes a perspective view of the vibration damper 114 of FIG. 11. FIG. 13 includes a side view of the vibration damper 114 of FIG. 11.

The vibration damper 114 of the handle portion 12 includes an outer portion 1104. The outer portion 1104 may form a hollow rectangular tube. Two or both sets of opposite sides of the outer portion 1104 may be convex as illustrated. The outer portion 1104 may have the same geometry/shape as an inner portion (interior walls) of the handle portion 12.

The vibration damper 114 also includes a central portion 1108 that is connected to the outer portion 1104. The central portion 1108 may be a solid cylindrical member or have another suitable shape. The central portion 1108 is connected to the outer portion 1104 via two or more arms, such as arms 1112. The arms 1112 extend radially outwardly from the central portion 1108 to the circular outer portion 1104. The arms 1112 may be straight or include one or more radially outward portions (masses), such as 1116 and/or 1120. The radially outward portions 1116 and/or 1120 may further damp vibration. The radially outward portions 1116 and 1120 have at least one dimension (e.g., a thickness) that is greater than the other portions of the arms 1112.

A thickness of the outer portion 1104 may be minimized to maximize a mass of the vibration damper 114 attributable to the arms 1112 and the central portion 1108. Maximizing a mass of the arms 1112 and the central portion 1108 increases damping of the vibration damper 114. While the example of two arms is provided, as discussed above, the vibration damper 114 may include more than two arms.

Example dimensions (in inches) for the vibration damper 114 are provided in FIGS. 11 and 13. As shown, the vibration damper 114 may have a length of 3 inches or another suitable length between approximately 1 and 8 inches. The vibration damper of a goalie stick may be longer than the vibration damper of a player stick, for example, to minimize weight of the player stick and to maximize damping of the goalie stick.

While example dimensions are provided, the present application is also applicable to other dimensions. For example, thicknesses of the arms and the outer portion of the vibration damper 114 may be between 0.02 and 0.04 inches in various implementations. A fraction of (a) a mass of the central portion 1108 and the arms divided by (b) a total mass of the vibration damper 114 (the mass of the central portion 308, the arms, and the circular outer portion) may be greater than the predetermined fraction to maximize vibration damping.

The vibration damper 114 may be fixed within the handle portion 12 of the hockey stick via an interference fit, via an adhesive, via double-sided tape, or in another suitable manner. The vibration damper 114 may be fixed within the handle portion 12, for example, before the blade portion 16 is connected to the handle portion 12.

Figure 14:
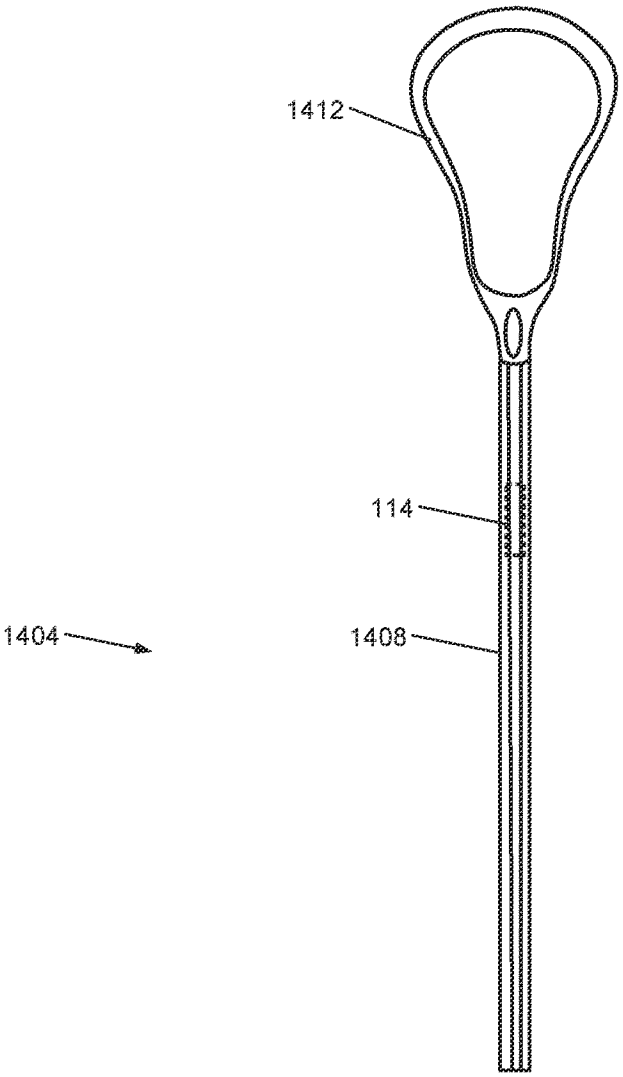
FIG. 14 includes an example illustration including a lacrosse stick having a vibration damper.

As another example, the vibration damper 114 may be implemented within a lacrosse stick. FIG. 14 includes an example illustration including a lacrosse stick 1404 having a vibration damper 114. The lacrosse stick 1404 includes a handle portion 1408, which a player holds, and a head portion 1412, which is used for controlling, passing, and shooting a lacrosse ball. The handle portion 1408 is tubular and can be elongated and longitudinally straight. The handle portion 1408 may include an offset where the handle portion 1408 deviates from being longitudinally straight near the portion where the handle portion 1408 connects to the head portion 1412.

Figure 15:
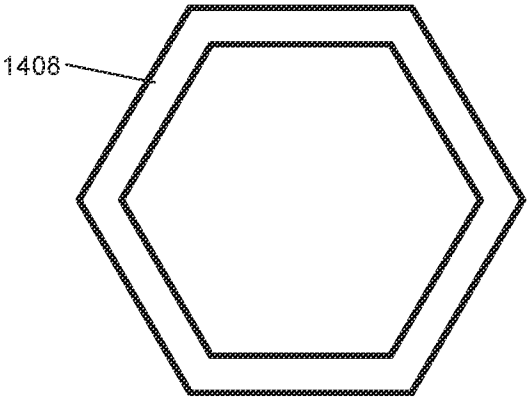
FIG. 15 includes a cross-sectional view of an example implementation of the handle portion of the lacrosse stick.

FIG. 15 includes a cross-sectional view of an example implementation of the handle portion 1408 of the lacrosse stick. The handle portion 1408 may be a hollow hexagonal tube and include 6 equal length sides, such as shown in the examples of FIG. 15. In various implementations, the sides may have two or more different lengths. In various implementations, one or more of the sides may be concave and/or one or more of the sides may be convex. Additionally or alternatively, corners where two sides meet may be rounded, square, or a combination of round and square. While the example of a hexagonal handle portion 1408 is provided, the handle portion 1408 may instead have 4 sides, 5 sides, or more than 6 sides. While an example shape is shown, the present application is also applicable to handle portions of lacrosse sticks other cross-sectional shapes.

Figure 16:
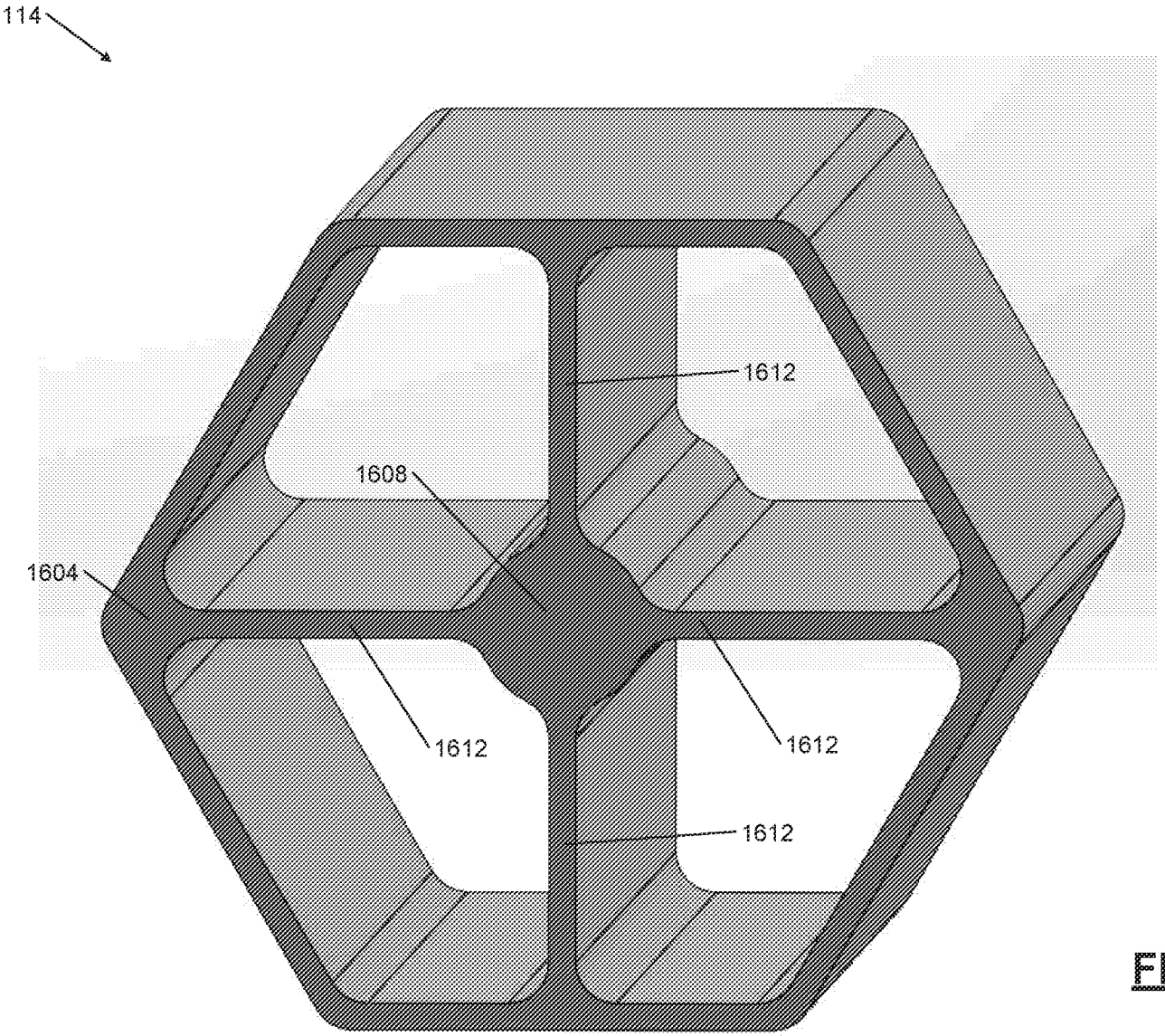
FIG. 16 includes a perspective end view of an example implementation of the vibration damper for a lacrosse stick.

FIG. 16 includes a perspective end view of an example implementation of the vibration damper 114 for a lacrosse stick (a player stick or a goalie stick).

The vibration damper 114 of the handle portion 1408 includes an outer portion 1604. The outer portion 1604 may form a hollow hexagonal tube. One or more pairs of opposite sides of the outer portion 1604 may be concave, convex, or a combination of concave and convex. The outer portion 1604 may have the same geometry/shape as an inner portion (interior walls) of the handle portion 1408.

The vibration damper 114 also includes a central portion 1608 that is connected to the outer portion 1604. The central portion 1608 may be a solid cylindrical member or have another suitable shape. The central portion 1608 is connected to the outer portion 1604 via two or more arms, such as arms 1612. The arms 1612 extend radially outwardly from the central portion 1608 to the outer portion 1604. The arms 1612 may be straight or include one or more radially outward portions, such as in the example of FIG. 11.

A thickness of the outer portion 1604 may be minimized to maximize a mass of the vibration damper 114 attributable to the arms 1612 and the central portion 1608. Maximizing a mass of the arms 1612 and the central portion 1608 increases damping of the vibration damper 114. While the example of four arms is provided, as discussed above, the vibration damper 114 may include two or more arms.

The vibration damper 114 may have a length of between approximately 0.5 inches and approximately 8 inches. Thicknesses of the arms and the outer portion of the vibration damper 114 may be between 0.02 and 0.04 inches in various implementations. A fraction of (a) a mass of the central portion 1608 and the arms divided by (b) a total mass of the vibration damper 114 (the mass of the central portion 1608, the arms, and the circular outer portion) may be greater than the predetermined fraction to maximize vibration damping.

The vibration damper 114 may be centered a predetermined distance (e.g., approximately 2 to 8 inches) from the end of the handle portion 1408 where the handle portion 1408 connects to the head portion 1412.

The vibration damper 114 may be fixed within the handle portion 1408 of the lacrosse stick via an interference fit, via an adhesive, via double-sided tape, or in another suitable manner.

Figure 17:
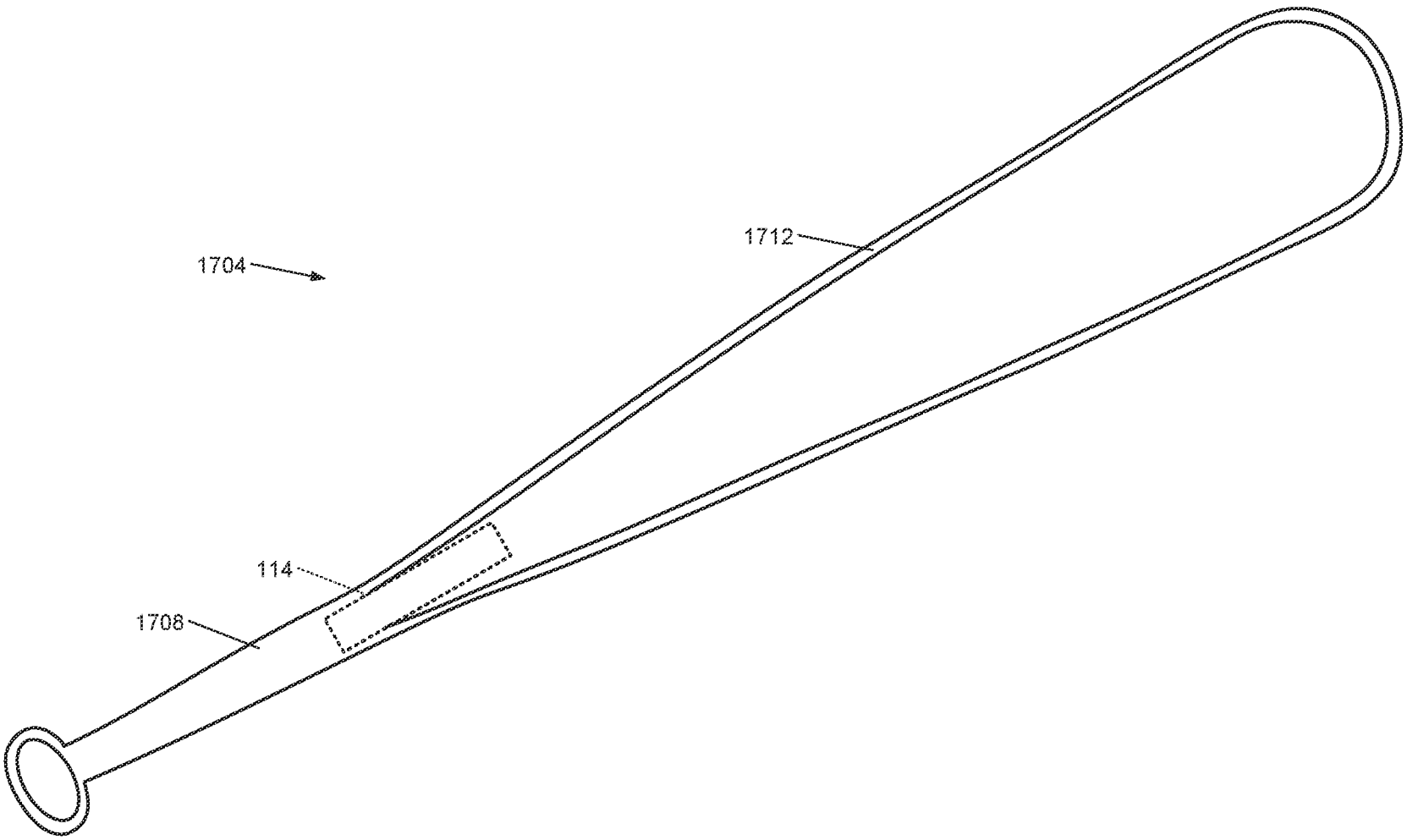
FIG. 17 includes an example illustration including a baseball bat including a vibration damper.

As another example, the vibration damper 114 may be implemented within a baseball bat. FIG. 17 includes an example illustration including a baseball bat 1704 including the vibration damper 114. The baseball bat 1704 includes a handle portion 1708, which a player holds, and a head or barrel portion 1712, which is used to bat a ball. The baseball bat 1704 may be a metal (e.g., aluminum) baseball bat, a composite baseball bat, or another type of hollow baseball bat.

Figure 18:
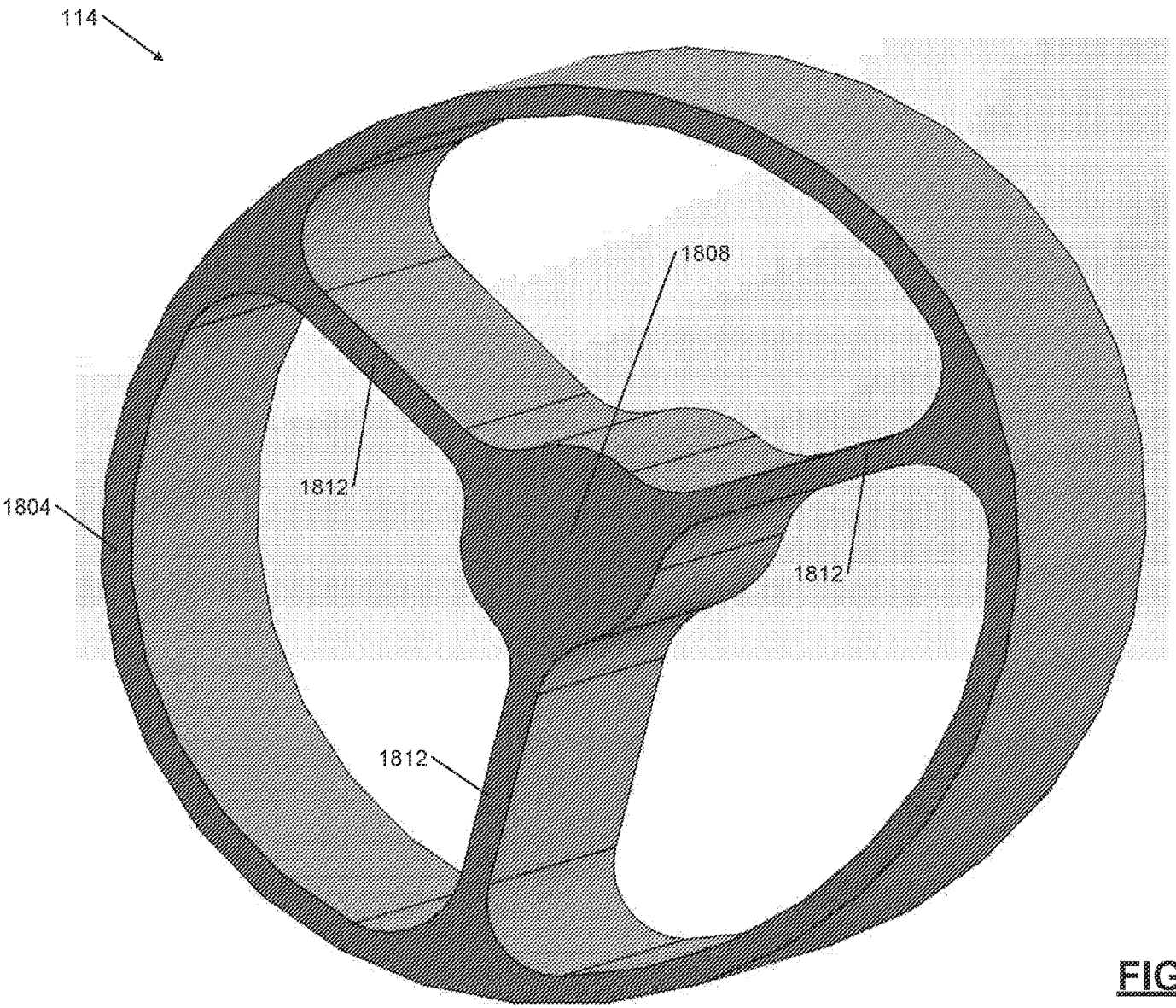
FIG. 18 includes a perspective end view of an example implementation of the vibration damper for a baseball bat.
Figure 20:
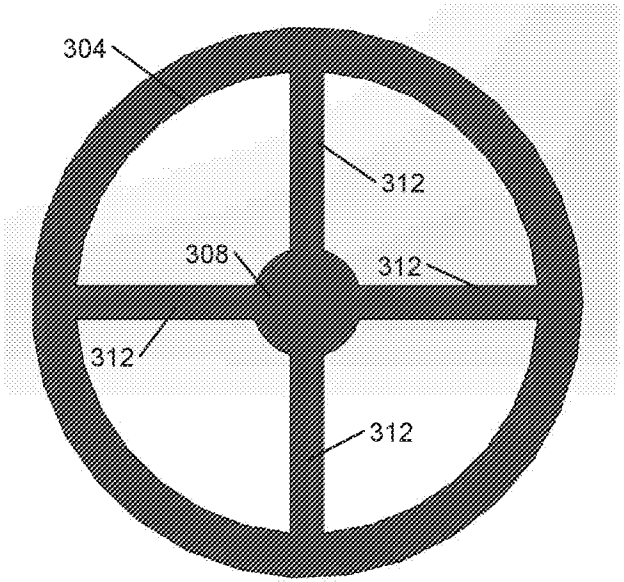
FIGS. 19-28 include other example implementations of vibration dampers for hollow sports shafts.
Figure 19:
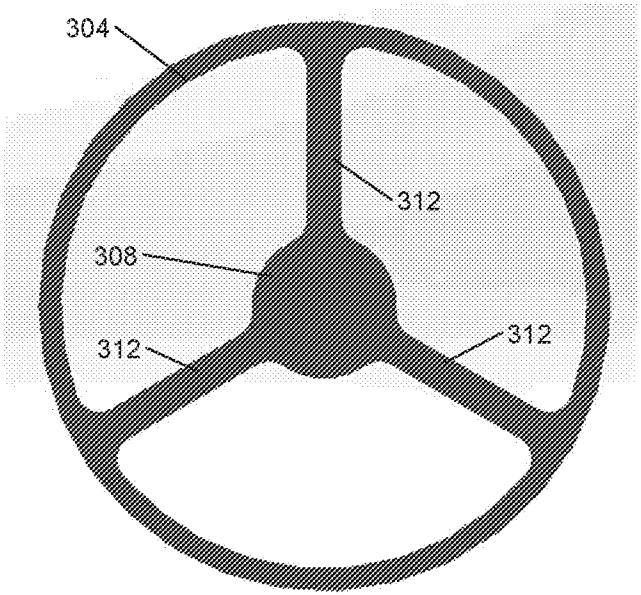
Figure 21:
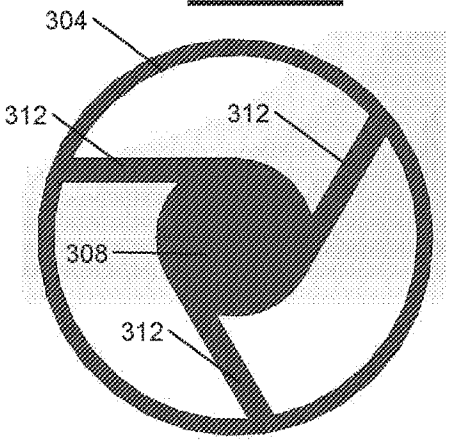

The handle portion 1708 where the vibration damper 114 is fixed may be a hollow frustoconical tube or a hollow cylindrical tube. FIG. 18 includes a perspective end view of an example implementation of the vibration damper 114 for a baseball bat.

The vibration damper 114 includes a circular outer portion 1804. The outer portion 1804 may form a hollow cylindrical tube (as shown in FIG. 18) or a hollow frustoconical tube. The outer portion 1804 may have the same geometry/shape as an inner portion (interior walls) of the handle portion 1708.

The vibration damper 114 also includes a central portion 1808 that is connected to the outer portion 1804. The central portion 1808 may be a solid cylindrical member or have another suitable shape. The central portion 1808 is connected to the outer portion 1804 via two or more arms, such as arms 1812. The arms 1812 extend radially outwardly from the central portion 1808 to the outer portion 1804. The arms 1812 may be straight or include one or more radially outward portions, such as in the example of FIG. 11. In various implementations, the arms 1812 of the vibration damper 114 of a baseball bat may be similar or identical to the arms of the example of FIGS. 4-6.

A thickness of the outer portion 1804 may be minimized to maximize a mass of the vibration damper 114 attributable to the arms 1812 and the central portion 1808. Maximizing a mass of the arms 1812 and the central portion 1808 increases damping of the vibration damper 114. While the example of three arms is provided, as discussed above, the vibration damper 114 may include two or more arms.

The vibration damper 114 may have a length of between approximately 0.5 inches and approximately 8 inches. Thicknesses of the arms and the outer portion of the vibration damper 114 may be between 0.02 and 0.04 inches in various implementations. A fraction of (a) a mass of the central portion 1108 and the arms divided by (b) a total mass of the vibration damper 114 (the mass of the central portion 1808, the arms, and the circular outer portion) may be greater than the predetermined fraction to maximize vibration damping.

The vibration damper 114 may be centered a predetermined distance (e.g., approximately 2 to 8 inches) from the end of the handle portion 1708 where the handle portion 1708 connects to the head or barrel portion 1712. Generally speaking, all of the vibration dampers 114 may be fixed within the respective shafts or handle portions between where impact occurs and where one or more hands of a user usually touch the shaft or handle portion The vibration damper 114 may be fixed within the handle portion 1708 of the bat via an interference fit, via an adhesive, via double-sided tape, or in another suitable manner.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A vibration damper to be inserted within an interior wall of a golf shaft, the vibration damper comprising:

an outer portion configured to directly contact and engage the interior wall of the golf shaft;

a central mass that extends coaxially with the outer portion and that is disposed within the outer portion;

three arms that extend outwardly and connect the central mass to the outer portion; and apertures disposed between the central mass and the outer portion, wherein the three arms include:

a first arm that extends radially outwardly from the central mass to the outer portion;

a second arm that includes a first portion that extends radially outwardly from the central mass toward the outer portion and a second portion that extends from the first portion and to the outer portion; and a third arm that includes a third portion that extends radially outwardly from the central mass toward the outer portion and a fourth portion that extends from the third portion and to the outer portion.

2. The vibration damper of claim 1 wherein a fraction of (a) a mass of the central mass and the three arms divided by (b) a total mass of the vibration damper is greater than one half.

3. The vibration damper of claim 1 wherein the vibration damper has a uniform mass per unit length.

4. The vibration damper of claim 1 wherein the outer portion, the central mass, and the three arms are made of a material having a hardness between approximately 40 and 100 A-shore hardness as measured by a shore durometer.

5. The vibration damper of claim 1 wherein the outer portion, the central mass, and the three arms are made of one of a viscoelastic material, an elastomeric material, thermoplastic polyurethane (TPU), polytetrafluoroethylene (PTFE), a rubber, a urethane poured foam, a solid foam, and a twisted braided round foam.

6. The vibration damper of claim 1 wherein the outer portion forms a cylindrical tube having an outer diameter that is between approximately 7/16 inches (1.11125 centimeters) and ½ inches (1.27 centimeters).

7. The vibration damper of claim 1 wherein the vibration damper is one of extruded, molded, and three dimensionally printed.

8. The vibration damper of claim 1 wherein a length of the vibration damper is between approximately 0.5 and 8 inches.

9. The vibration damper of claim 1 wherein a total mass of the vibration damper is between 2 and 4 grams.

10. The vibration damper of claim 1 wherein an outer surface of the outer portion includes features configured to engage the interior wall of the golf shaft.

11. The vibration damper of claim 1 wherein the outer portion forms one of a squircle shaped tube, a cylindrical tube, a hexagonal tube, a rectangular tube, and an octagonal tube.

12. The vibration damper of claim 1 wherein one or more sides of the outer portion are one of convex and concave.

13. The vibration damper of claim 1 wherein the central mass incudes a hollow aperture through its center.

14. The vibration damper of claim 13 further comprising an insert disposed within the hollow aperture.

15. A vibration damper to be inserted within an interior wall of a golf shaft, the vibration damper comprising:

an outer portion configured to directly contact and engage the interior wall of the golf shaft;

a central mass that extends coaxially with the outer portion and that is disposed within the outer portion;

at least two arms that extend outwardly and connect the central mass to the outer portion; and apertures disposed between the central mass and the outer portion, wherein an outer surface of the outer portion includes features configured to engage the interior wall of the golf shaft, the features being one of ridges, scallops, and concave portions, the features being arranged directly adjacent to each other around the entirety of the outer portion.

16. The vibration damper of claim 15 wherein a fraction of (a) a mass of the central mass and the at least two arms divided by (b) a total mass of the vibration damper is greater than one half.

* * * * *